US008368682B2

(12) United States Patent
Kim et al.

(10) Patent No.: US 8,368,682 B2
(45) Date of Patent: Feb. 5, 2013

(54) ADDRESS DRIVING CIRCUIT AND PLASMA DISPLAY DEVICE HAVING THE SAME

(75) Inventors: Joung-Ho Kim, Suwon-si (KR); Hyo-Sang Youn, Yongin-si (KR); Tae-Ho Kwon, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 522 days.

(21) Appl. No.: 12/634,227

(22) Filed: Dec. 9, 2009

(65) Prior Publication Data

US 2010/0164932 A1 Jul. 1, 2010

(30) Foreign Application Priority Data

Dec. 29, 2008 (KR) ..... 10-2008-0135122

(51) Int. Cl.
*G09G 5/00* (2006.01)

(52) U.S. Cl. ..... 345/211; 345/60; 345/67; 345/63; 345/204; 345/212

(58) Field of Classification Search ..... 345/211, 345/60, 67, 63, 212, 204
See application file for complete search history.

(56) References Cited

U.S. PATENT DOCUMENTS

2003/0214462 A1* 11/2003 Roh et al. ..... 345/60
2004/0257308 A1* 12/2004 Yang ..... 345/63
2005/0073483 A1* 4/2005 Lee et al. ..... 345/63
2006/0050021 A1* 3/2006 Choi ..... 345/60
2008/0100538 A1* 5/2008 Byeon ..... 345/67
2008/0117137 A1* 5/2008 Kim ..... 345/60
2009/0256828 A1* 10/2009 Byeon ..... 345/204

FOREIGN PATENT DOCUMENTS

KR 10-0612508 8/2006
KR 10-0739640 7/2007
KR 1020080039054 5/2008

OTHER PUBLICATIONS

English Abstract for Publication No. 10-0612508.
English Abstract for Publication No. 10-0739640.
English Abstract for Publication No. 1020080039054.

* cited by examiner

*Primary Examiner* — Wayne Young
*Assistant Examiner* — Linh N Hoffner
(74) *Attorney, Agent, or Firm* — F. Chau & Associates, LLC

(57) ABSTRACT

An address driving circuit includes a driving device unit and an energy recovery circuit. The driving device unit drives an address electrode to an address voltage or a reference voltage in response to driving control signals during an address period. The energy recovery circuit recovers a voltage charged to the address electrode in response to switching control signals such that a voltage of the address electrode transitions to the address voltage or the reference voltage via at least two intermediate voltages including first and second intermediate voltages during the address period.

17 Claims, 9 Drawing Sheets

ADDRESS DRIVING CIRCUIT AND PLASMA DISPLAY DEVICE HAVING THE SAME

CROSS-REFERENCE TO RELATED APPLICATION

This application claims under 35 U.S.C. §119 priority to and the benefit of Korean Patent Application No. 2008-0135122, filed on Dec. 29, 2008 in the Korean Intellectual Property Office (KIPO), the entire contents of which are incorporated by reference herein.

BACKGROUND

1. Technical Field

The present disclosure relates to display devices, and, more particularly, to a plasma display device and its address driving circuit.

2. Discussion of Related Art

A plasma display device is one of the flat panel devices that have attracted attention recently. The plasma display device includes a plasma display panel and a driver for driving the plasma display panel.

The plasma display panel includes a front panel, a rear panel and barrier ribs formed between the front panel and the rear panel. A barrier ribs unit includes discharge cells. Each of the discharge cells corresponds to a pixel of the plasma display panel. When driving voltages are applied to each of the discharge cells through a plurality of electrodes, vacuum ultraviolet light is generated by discharge in each of the discharge cells. The ultraviolet light causes phosphors formed between the barrier ribs to emit visible light, and the plasma display panel, in turn, displays an image corresponding to input image data by using the visible light.

However, the plasma display device typically uses a high-level voltage for driving the electrodes which creates problematic heat radiation, energy inefficiency and electromagnetic interference (EMI).

SUMMARY

Exemplary embodiments of the present inventive concept provide an address driving circuit capable of reducing EMI and increasing energy efficiency.

Exemplary embodiments provide a plasma display device including the address driving circuit.

According to an exemplary embodiment an address driving circuit includes a driving device unit configured to drive an address electrode to an address voltage or a reference voltage in response to driving control signals during an address period, and an energy recovery circuit configured to recover a voltage charged to the address electrode in response to switching control signals such that a voltage of the address electrode transitions to the address voltage or the reference voltage through at least two intermediate voltages including a first intermediate voltage and a second intermediate voltage during the address period.

The energy recovery circuit may raise the voltage of the address electrode from the reference voltage to the first intermediate voltage in response to a first switching control signal, and may raise the voltage of the address electrode from the first intermediate voltage to the second intermediate voltage in response to a second switching control signal when the voltage of the address electrode rises from the reference voltage to the address voltage.

The energy recovery circuit may lower the voltage of the address electrode from the address voltage to the second intermediate voltage in response to a second switching control signal, and may lower the voltage of the address electrode from the second intermediate voltage to the first intermediate voltage in response to a first switching control signal when the voltage of the address electrode falls from the address voltage to the reference voltage.

The energy recovery circuit may include a first switching element, connected to the address electrode, which receives a first switching control signal, a second switching element, connected to the address electrode and to the first switching element in parallel, which receives a second switching control signal, a first energy recovery capacitor, connected to the first switching element, which recovers the voltage charged to the address electrode, and a second energy recovery capacitor, connected to the second switching element, which recovers the voltage charged to the address electrode.

A first rising transition time period may be determined based upon a first turn-on time period of the first switching element in response to the first switching control signal and a second rising transition time period is determined based upon a second turn-on time period of the second switching element in response to the second switching control signal. The first rising transition may be a time period for the voltage of the address electrode to rise from the reference voltage to the first intermediate voltage, and the second rising transition time period may be a time period for the voltage of the address electrode rising from the first intermediate voltage to the second intermediate voltage.

The first switching element and the second switching element may be symmetric double diffusion MOS transistors.

The first switching element and second switching element may be n-type symmetric double diffusion MOS transistors.

The first switching element and the second switching element may be p-type symmetric double diffusion MOS transistors.

The driving device unit may include a first driving device, connected to a first power supply voltage having a level of the address voltage, which pulls-up the voltage of the address electrode to the address voltage in response to a first driving control signal, and a second driving device, connected to a second power supply voltage having a level of the reference voltage, which pulls-down the voltage of the address electrode to the reference voltage in response to a second driving control signal.

The first driving device may be an NMOS transistor and the second driving device may be a PMOS transistor.

The address driving circuit may further include a control unit configured to generate the driving control signals and the switching control signals.

The address driving circuit may further include a delay unit that controls delay time periods of the switching control signals to provide delayed control signals.

A first falling transition time period and a second falling transition time period may be determined based upon the delay time periods of the switching control signals. The first falling transition time period may be a time period for the voltage of the address electrode to fall from the address voltage to the second intermediate voltage and the second falling transition time period may be a time period for the voltage of the address electrode to fall from the second intermediate voltage to the first intermediate voltage.

According to an exemplary embodiment a plasma display device includes a plasma display panel comprising a plurality of address electrodes, and an address driving unit having an energy recovery circuit, the address driving unit configured to drive a voltage of each address electrode from a reference voltage to an address voltage through a first intermediate voltage and a second intermediate voltage by using a voltage stored in the energy recovery circuit or configured to drive the voltage of the address electrode from the address voltage to the reference voltage through the second intermediate voltage and the first intermediate voltage by recovering the voltage of the address electrode to the energy recovery circuit, in response to control signals.

In accordance with an exemplary embodiment a plasma display device includes a plasma display panel having a discharge space, a scan driving unit having scan electrodes that cross the plasma display panel, a sustain driving unit having sustain electrodes that cross the plasma display panel, each sustain electrode being paired with a scan electrode, and an address driving unit having address electrodes that cross the scan electrodes and the sustain electrodes. Discharges occur in the discharge space and images are displayed on the plasma display panel in response to respective driving voltages applied to the address electrodes, to the scan electrodes and to the sustain electrodes during subfields of a frame, the subfields each having at least a reset period and an address period. During the address period an address discharge for selecting a discharge cell to be discharged is generated by a voltage difference between an address voltage of the address electrodes and a scan voltage of the scan electrodes. During the address period, a scan pulse is applied to the scan electrodes while an address signal is applied to the address electrode, the address signal going through at least two intermediate voltages during a transition time period to reach the address voltage such that when a voltage difference between the scan pulse and the address signal is added to a wall voltage generated during the reset period preceding the address period, the address discharge is generated within the discharge space to which the address signal is applied.

The at least two intermediate voltages may be provided as a first stage transitioning voltage that transitions from a first voltage to a second voltage that is greater than the first voltage and a second stage transitioning voltage that follows the first stage transitioning voltage and that transitions from the second voltage to the address voltage that is greater than the second voltage.

The at least two intermediate voltages may be provided from respective capacitors of an energy recovery circuit coupled to the address electrodes.

During a time period after the address voltage is applied voltages may be recovered from a panel capacitance between the address electrode and the scan electrode to the capacitors of the energy recovery circuit.

Accordingly, the plasma device of the exemplary embodiments drives the address electrodes to a high voltage or a lower voltage via at least two intermediate voltages, thereby increasing energy efficiency and reducing EMI by using the energy recovery circuit.

BRIEF DESCRIPTION OF THE DRAWINGS

Illustrative, non-limiting exemplary embodiments of the inventive concept of the present application will be more clearly understood from the following detailed description taken in conjunction with the accompanying drawings.

DETAILED DESCRIPTION OF THE EMBODIMENTS

Figure 1:
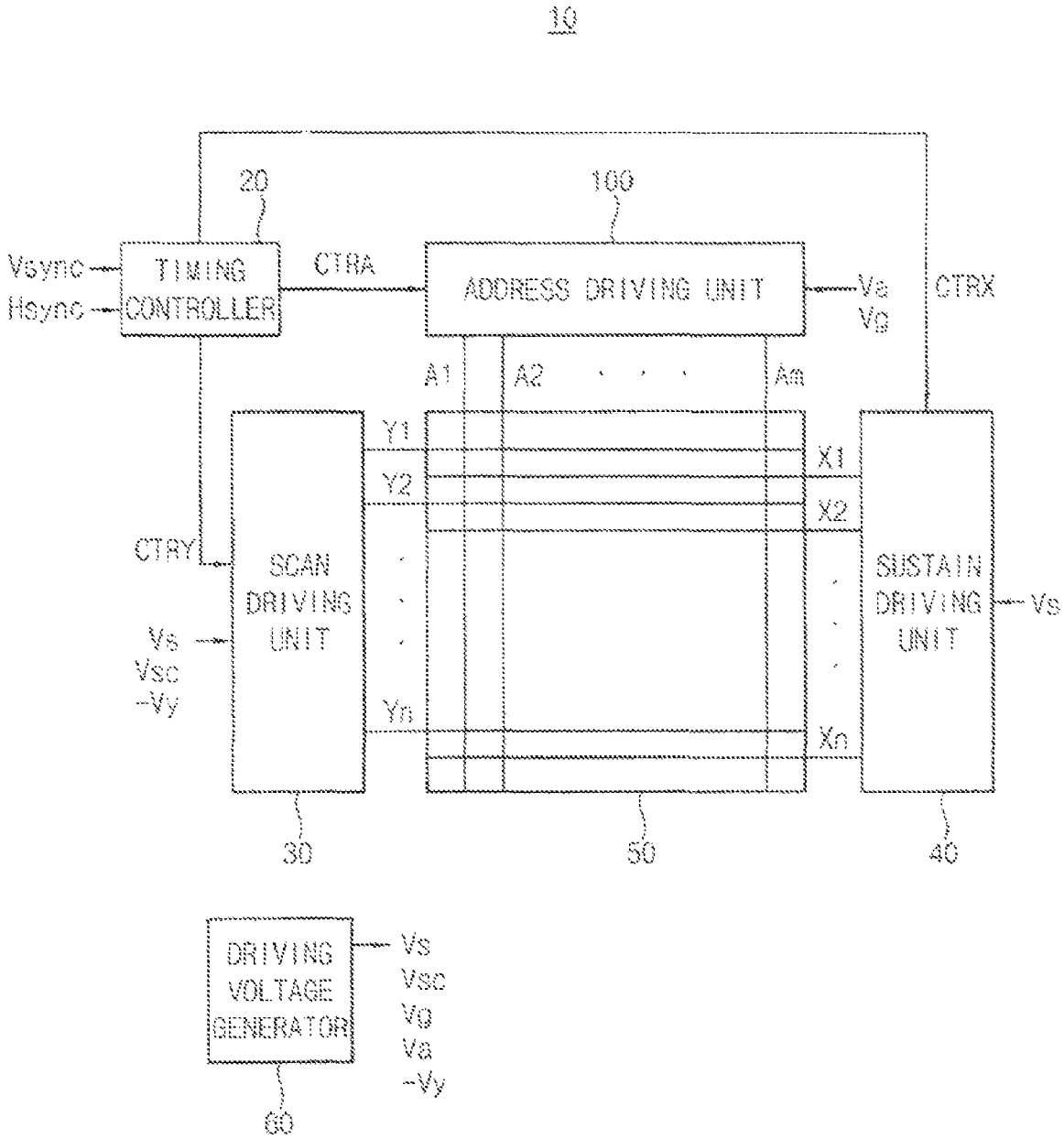
FIG. 1 is a block diagram illustrating a plasma device according to an exemplary embodiment.

Various exemplary embodiments of the inventive concept will be described more fully hereinafter with reference to the accompanying drawings. In the drawings, like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

FIG. 1 is a block diagram illustrating a plasma device according to an exemplary embodiment.

Referring to FIG. 1, a plasma display device 10 includes a timing controller 20, a scan driving unit 30, a sustain driving unit 40, an address driving unit 100, a plasma display panel 50, and a driving voltage generator 60.

A gas discharge occurs in a discharge space filled with an inert gas, and thus displays images on the plasma display panel 50 by applying respective driving voltages to address electrodes A1-Am, to scan electrodes Y1-Yn, and to sustain electrodes X1-Xn. The address driving unit 100 (also referred to as data driving unit) provides data to the address electrodes A1-Am formed on a rear panel (not illustrated). The scan driving unit 30 drives the scan electrodes Y1-Yn by providing various pulse voltages to the scan electrodes Y1-Yn formed on a front panel (not illustrated). The sustain driving unit 40 drives the sustain electrodes X1-Xn formed on the front panel. The timing controller 20 controls the address driving unit 100, the scan driving unit 30, and the sustain driving unit 40 by providing control signals CRTA, CRTY, CRTX to the address driving unit 100, the scan driving unit 30, and the sustain driving unit 40. The driving voltage generator 60 provides driving voltages to each of the timing controller 20, the address driving unit 100, the scan driving unit 30, and the sustain driving unit 40.

A more detailed description of the plasma display device 10 will now be provided.

Although not illustrated, the plasma display panel 50 includes a front panel and a rear panel which are coupled in parallel to oppose each other at a given distance therebetween and having a discharge space containing inert gas. A plurality of electrodes such as the scan electrodes Y1-Yn and the sustain electrodes X1-Xn are formed in pairs on the front panel. A plurality of address electrodes A1-Am are formed on the rear panel intersecting the scan electrodes Y1-Yn and the sustain electrodes X1-Xn.

The address driving unit 100 receives data mapped for each subfield in a predetermined subfield pattern. The address driving unit 100, under the control of the timing controller 20, samples and latches the mapped data, and then provides the data to the address electrodes A1-Am The scan driving unit 30, under the control of the timing controller 20, provides a setup pulse and a setdown pulse to the scan electrodes Y1-Yn during the reset period. After providing a reset pulse including the setup pulse and the reset pulse, the scan driving unit 30 provides a scan reference voltage Vsc and a scan pulse SCN falling from the scan reference voltage Vsc to a negative voltage level −Vy to the scan electrodes Y1-Yn during the address period, thereby selecting a scan line. In addition, the scan driving unit 30 provides a sustain pulse SUS to the scan electrodes Y1-Yn during the sustain period, thereby generating sustain discharge in a discharge cell selected during the address period.

The sustain driving unit 30, under the control of the timing controller 20, provides a bias voltage having a voltage level lower than a sustain voltage level Vs to the sustain electrodes X1-Xn during at least a portion of the reset period and the address period. Then, the sustain driving unit 30 provides the sustain pulse SUS having the sustain voltage level Vs to the sustain electrodes X1-Xn during the sustain period. The scan driving unit 30 and the sustain driving unit 40 alternately operate during the sustain period.

The timing controller 20 receives a vertical synchronization signal Vsync and a horizontal synchronization signal Hsync, and generates the timing control signals CTRA, CTRY and CTRX for the address driving unit 100, the scan driving unit 30, and the sustain driving unit 40, respectively. The timing controller 20 provides the timing control signals CTRA, CTRY, CTRX to each of the address driving unit 100, the scan driving unit 30, and the sustain driving unit 40 for controlling each of the address driving unit 100, the scan driving unit 30, and the sustain driving unit 40.

The timing control signal CTRA provided to the address driving unit 100 includes a sampling clock for sampling data, a latch control signal and control signals for controlling an energy recovery circuit and a driving device in the address driving unit 100. The timing control signal CTRY provided to the scan driving unit 30 includes control signals for controlling an energy recovery circuit a driving device in the scan driving unit 30. The timing control signal CTRX provided to the sustain driving unit 40 includes control signals for controlling an energy recovery circuit a driving device in the sustain driving unit 40.

The driving voltage generator 60 generates various driving voltages for the address driving unit 100, the scan driving unit 30, and the sustain driving unit 40, for example, a sustain voltage Vs, a scan reference voltage Vsc, an address voltage Va, and a scan voltage −Vy. These driving voltages may vary according to the composition of a discharge gas or the structure of the discharge cells.

Figure 2A:
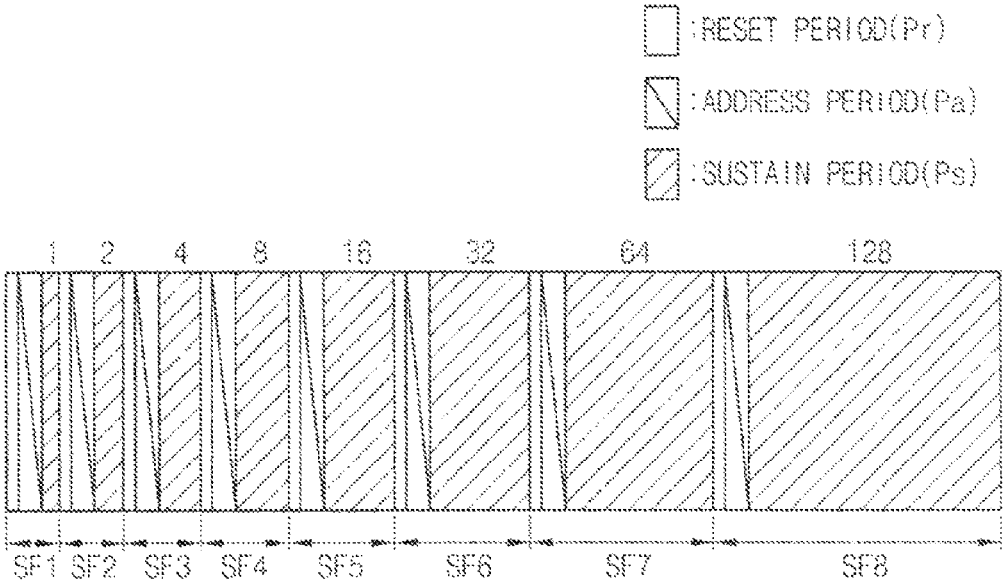
FIG. 2A is a diagram for explaining a frame for achieving gray level of an image display on the plasma display panel in FIG. 1.

FIG. 2A is a diagram for explaining a frame for achieving the gray level of an image display on the plasma display panel in FIG. 1.

Referring to FIG. 2A, the plasma display device 10 is driven by dividing a frame into several subfields having different amount of emission time. Each of the subfields is subdivided into a reset period Pr for initializing all discharge cells, an address period Pa for selecting a scan line and for selecting a discharge cell from the selected scan line, and a sustain period Ps for presenting the gray level according to the number of discharges.

For example, when an image with 256 gray level is to be displayed, a frame period (for example, 16.67 ms) corresponding to 1/60 sec is divided into eight subfields SF1-SF8. Each of the subfields SF1-SF8 is subdivided into a reset period Pr, an address period Pa, and a sustain period Ps.

The duration of the reset period Pr in a subfield is equal to the durations of the reset periods in the remaining subfields. The duration of the address period Pa in a subfield is equal to the durations of the address periods in the remaining subfields. The duration of the sustain period increases in a ratio of $2^n$ (where n=0, 1, 2, 3, 4, 5, 6, 7) in each of the subfields.

An address discharge for selecting a discharge cell to be discharged is generated by a voltage difference between the address electrodes A1-Am and the scan electrodes Y1-Yn. During each sustain period, a sustain pulse is alternatively applied to the scan electrodes Y1-Yn and the sustain electrodes X1-Xn to generate a sustain discharge in discharge cells having wall charges during each address period.

The luminance of the plasma display panel 50 is proportional to the number of sustain pulses generated during the sustain periods (Ps) of the unit frame. In the case where the unit frame displaying one image is represented by 8 subfields and 256-level gray scale, a different number of sustain pulses in a ratio 1, 2, 4, 8, 32, 34 and 128 may be assigned to each of 8 subfields SF1-SF8 in turn. For obtaining the luminance of a 133-level gray scale, sustain discharges are performed by addressing discharge cells during the subfields SF1, SF3, SF8.

The number of sustain discharges assigned to each subfield may be determined based upon the gray weights of the subfields. In other words, while FIG. 2A illustrates a case where one frame is divided into 8 subfields as an example, the inventive concept is not limited thereto. The number of subfields constituting one frame may vary based upon the design specification. For example, one frame may include 12 or 16 subfields.

The number of sustain discharges assigned to each subfield may also vary taking into consideration a gamma characteristics or panel characteristics. For example, a gray scale assigned to the subfield SF4 may be reduced from 8 to 6, and a gray scale assigned to the subfield SF6 may be raised from 32 to 34.

Figure 2B:
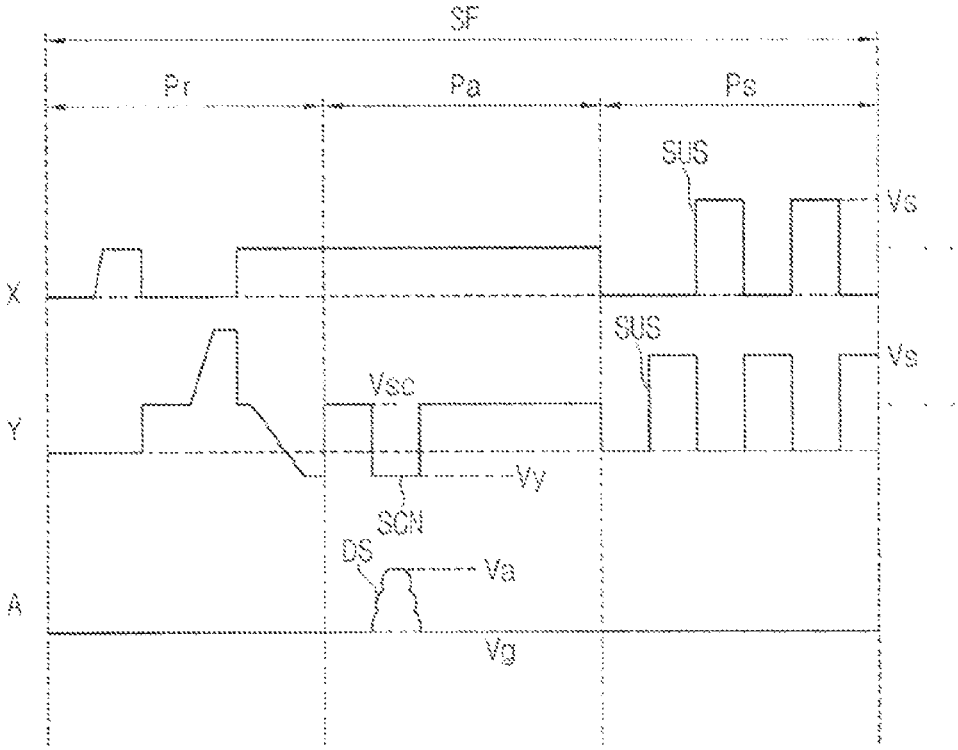
FIG. 2B is an exemplary one field timing diagram of driving signals for driving the plasma display device of FIG. 1.

FIG. 2B is an exemplary one field timing diagram of driving signals for driving the plasma display device of FIG. 1.

Each subfield SF includes a reset period Pr, an address period Pa and a sustain period Ps.

During the reset period Pr, a setup pulse and a setdown pulse are applied to the scan electrodes Y. When the setup pulse is applied to the scan electrodes Y, a first discharge is generated within all discharge cells, and thus, wall charges are formed. When the setdown pulse is applied to the scan electrodes Y, an erase discharge is generated within all the discharge cells. Due to the erase discharge, the wall charges produced by the setup discharge and unnecessary charges among space charges are erased.

During the address period Pa, a scan pulse SCN of a negative polarity is sequentially applied to the scan electrodes Y and, at the same time, an address signal DS is applied to the address electrode A. As will be described in more detail later, the address signal DS goes through at least two intermediate voltages in a transition time period. When the voltage difference between the scan pulse SCN and the data signal DS is added to a wall voltage generated during the reset period Pr, an address discharge is generated within the discharge cells to which the date signal DS is applied. A signal maintained at a sustain voltage level Vs is applied to the sustain electrodes X while the setdown pulse is applied and during the address period Pa.

During the sustain period Ps which follows the address period Pa, a sustain pulse SUS is alternately applied to the scan electrodes Y and the sustain electrodes X. Every time the sustain pulse SUS is applied, a sustain discharge of a surface discharge type, i.e., a display discharge, is generated between the scan electrodes Y and the sustain electrodes X. FIG. 2B illustrates the case where one discharge cell is selected in the plasma display device 10 of FIG. 1, as an example.

Since the driving waveforms illustrated in FIG. 2B are only an exemplary embodiment of the signals for driving the plasma display panel 10 of FIG. 1, the inventive concept is not limited thereto. For example, polarities and voltage levels of the driving signals illustrated in FIG. 2B may be changed, and an erase signal for erasing the wall charges may be applied to the sustain electrodes X after the generation of the sustain discharge. In addition, the plasma display panel 50 may be driven in a single sustain type for generating a sustain discharge by applying a sustain pulse to either the scan electrodes Y or the sustain electrodes X.

Figure 3:
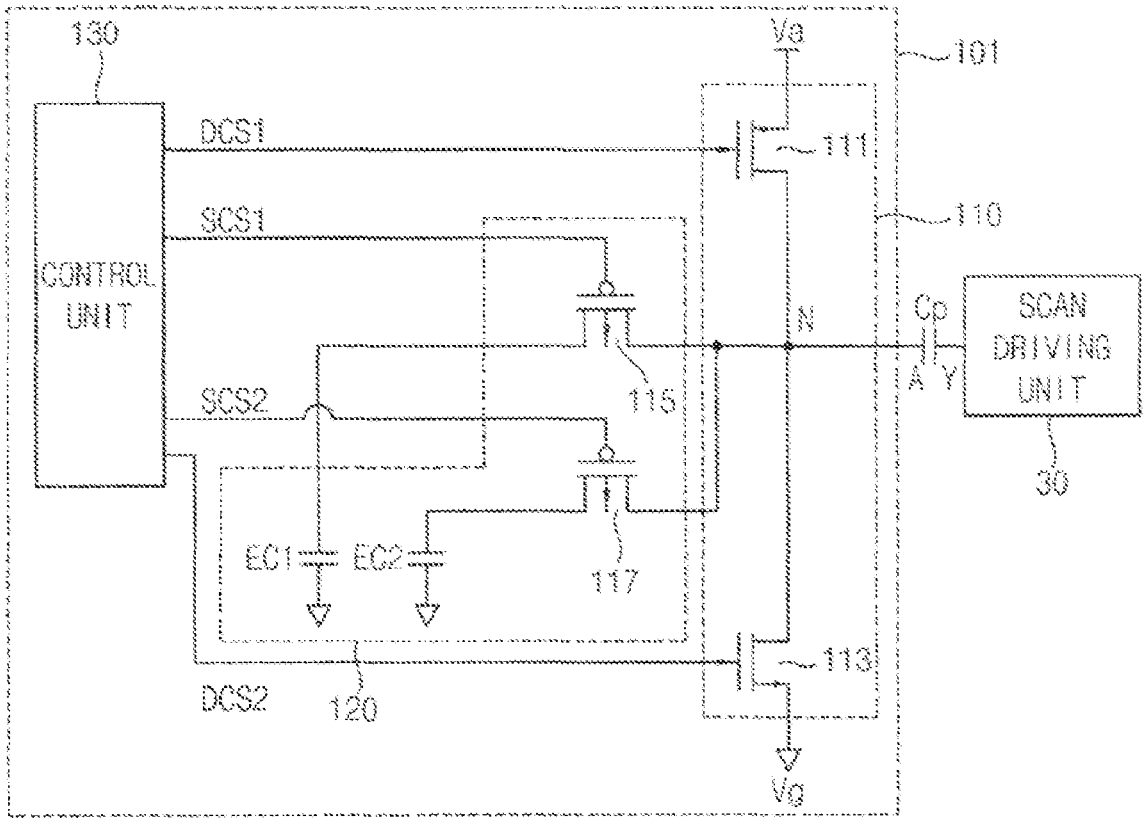
FIG. 3 is a circuit diagram illustrating an address driving circuit included in the address driving unit in FIG. 1 according to an exemplary embodiment.

Referring now to FIG. 3, a detailed description of the address driving unit 100 for applying the data signal DS corresponding to the scan pulse SCN to the address electrodes A during the address period Pa will be provided.

FIG. 3 is a circuit diagram illustrating an address driving circuit included in the address driving unit in the exemplary embodiment of FIG. 1.

The address driving unit 100 in FIG. 1 may include a plurality of address driving circuits such as the address driving circuit 101 of FIG. 3.

Referring to FIG. 3, an address driving circuit 101 includes a driving device unit 110 and an energy recovery circuit 120. The address driving circuit 101 may further include a control unit 130.

The driving device unit 110 drives the address electrode A to an address voltage Va or a reference voltage Vg in response to first and second driving control signals DCS1, DCS2. The energy recovery circuit 120 recovers a voltage charged to a panel capacitor Cp or provides a charged voltage again to the panel capacitor Cp. Here, the panel capacitor Cp indicates the equivalent capacitance between the address electrode A and the scan electrode Y.

More particularly, the driving device unit 110 includes a first driving device 111 connected to a first power supply voltage (hereinafter "address voltage") having an address voltage level Va, a second driving device 113 connected to a second power supply voltage (hereinafter "reference voltage") having reference voltage level Vg. The first driving device 111 and the second driving device 113 are connected to each other at a node N. The first driving device 111 may be a p-type metal oxide semiconductor (MOS) transistor and the second driving device 113 may be a n-type MOS transistor. The first driving control signal DCS1 is applied to the first driving device 111, and the second driving control signal DCS2 is applied to the second driving device 113.

The energy recovery circuit 120 includes a first energy recovery capacitor EC1, a second energy recovery capacitor EC2, a first switching element 115, and a second switching element 117. The first switching element 115 is connected between the first energy recovery capacitor EC1 and the address electrode A. The second switching element 117 is connected between the second energy recovery capacitor EC2 and the address electrode A. As will be described later, the first and second switching elements 115, 117 may be implemented by p-channel symmetric double diffusion MOS transistors. A first switching control signal SCS1 is applied to the first switching element 115 and a second switching control signal SCS2 is applied to the second switching element 117.

The control unit 130 generates the first and second driving control signals DCS1, DCS2 and the first and second switching control signals SCS1, SCS2. The control unit 130 may be implemented within the address driving unit 100 or outside of the address driving unit 100. When the control unit 130 is implemented outside of the address driving unit 100, the control unit 130 may be included in the timing controller 20 in FIG. 1.

Figure 4:
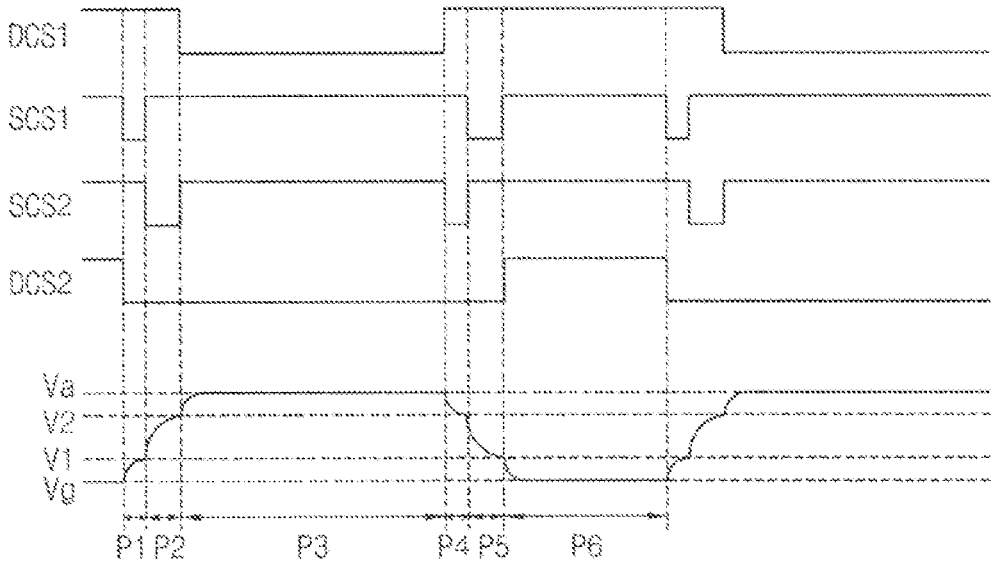
FIG. 4 is a timing diagram illustrating control signals of FIG. 3 and the data signal applied to the address electrode.

FIG. 4 is a timing diagram illustrating the control signals of FIG. 3 and the data signal applied to the address electrode.

Referring now to FIG. 4, a more detailed description of the address driving unit 100 of FIG. 3 will be provided.

Assuming that before a P1 time period, a voltage charged to the panel capacitor Cp is 0V, and a predetermined voltage is charged to the first and second energy recovery capacitors EC1, EC2.

During the P1 time period, the first switching element 115 is turned on by the first switching control signal SCS1. Therefore, a voltage charged to the first energy recovery capacitor EC1 is provided to the panel Cp through the address electrode A. That is, a voltage of the address electrode A rises from the reference voltage Vg to a first intermediate voltage V1. The rising transition time period for the voltage of the address electrode A, rising from the reference voltage Vg to a first intermediate voltage V1, may be determined based upon the turn-on time period of the first switching element 115 in response to the first switching control signal SCS1. That is, the rising transition time period for the voltage of the address electrode A, rising from the reference voltage Vg to the first intermediate voltage V1 may be controlled by controlling the turn-on time period of the first switching element 115 by the first switching control signal SCS1.

During the P2 time period, the first switching element 115 is turned off and the second switching element 117 is turned on by the second switching control signal SCS2. A voltage charged to the second energy recovery capacitor EC2 is provided to the panel Cp through the address electrode A. That is, the voltage of the address electrode A rises from the first intermediate voltage V1 to a second intermediate voltage V2. The rising transition time period for the voltage of the address electrode A, rising from the first intermediate voltage V1 to the second intermediate voltage V2, may be determined based upon a turn-on time period of the second switching element 117 in response to the second switching control signal SCS2. That is, the rising transition time period for the voltage of the address electrode A, rising from the first intermediate voltage V1 to the second intermediate voltage V2, may be controlled by controlling the turn-on time period of the second switching element 117 by the second switching control signal SCS2.

During the P3 time period, the second switching element 117 is turned off and the first driving device 111 is turned on by the first driving control signal DCS1. The first driving device 111 pulls-up the node N to the address voltage Va.

Therefore, during the P3 time period, the voltage of the address electrode A rises from the second intermediate voltage V2 to the address voltage Va, and is maintained at the address voltage Va.

During the P4 time period, the first driving device 111 is turned off and the second switching element 117 is turned on again by the second switching control signal SCS2. Therefore, a portion of the voltage charged to the panel capacitor Cp is recovered to the second energy recovery capacitor EC2. That is, during the P4 time period, the voltage of the address electrode A falls from the address voltage Va to the second intermediate voltage V2.

During the P5 time period, the second switching element 117 is turned off and the first switching element 115 is turned on again by the first switching control signal SCS1. Therefore, a portion of the voltage charged to the panel capacitor Cp is recovered to the first energy recovery capacitor EC1. That is, during the P5 time period, the voltage of the address electrode A falls from the second intermediate voltage V2 to the first intermediate voltage V1.

During the P6 time period, the first switching element 115 is turned off and the second driving device 113 is turned on again by the second driving control signal DCS2. Therefore, the second driving device 113 pulls-down the node N to the reference voltage Vg. That is, during the P6 time period, the voltage of the address electrode A falls from the first intermediate voltage V1 to the reference voltage Vg and is maintained the reference voltage Vg.

For the time periods after the P6 time period, the same operations as described with regard to the time periods P1-P6 will be repeated.

FIGS. 5A to 5F illustrate the operation of the address driving circuit of FIG. 3 when the control signals of FIG. 4 are applied.

Figure 5A:
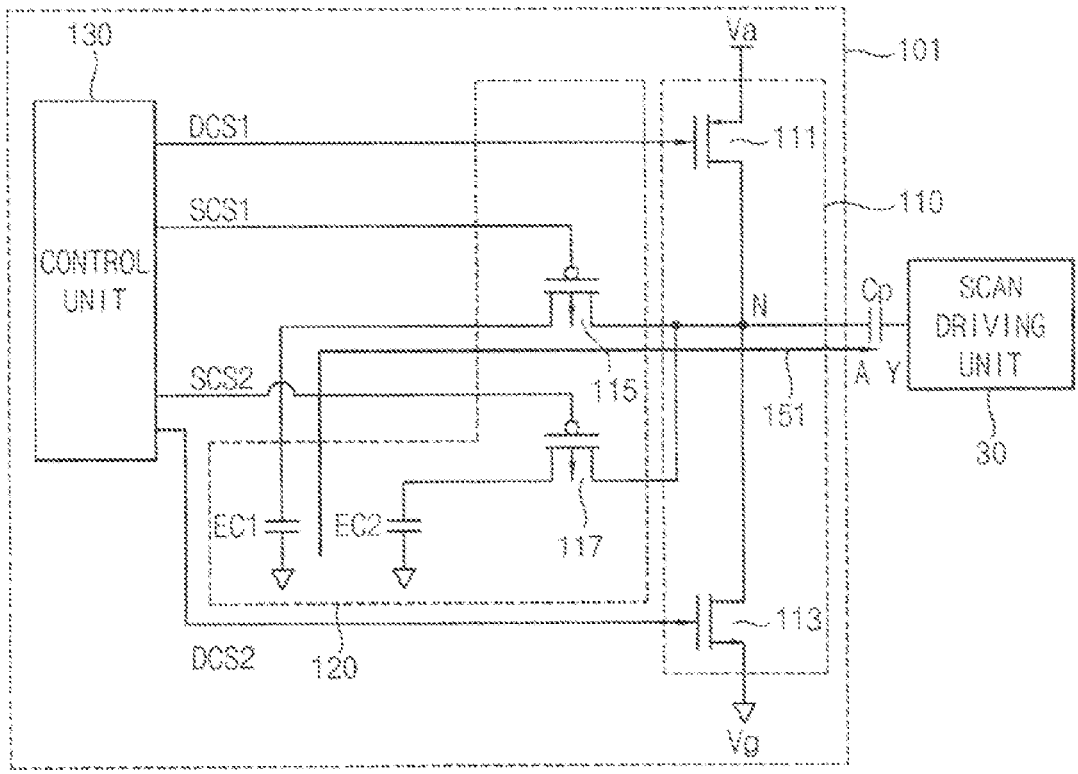
FIGS. 5A, 5B, 5C, 5D, 5E and 5F illustrate the operation of the address driving circuit of FIG. 3 when the control signals of FIG. 4 are applied.

Referring to FIG. 5A, as is described with reference to FIG. 4, during the P1 time period, the first switching element 115 is turned on, and a current path 151 is formed from the first energy recovery capacitor EC1 through the first switching element 115 and the node N to the panel capacitor Cp, and thus, the voltage of the address electrode A rises from the reference voltage Vg to the first intermediate voltage V1.

Figure 5B:
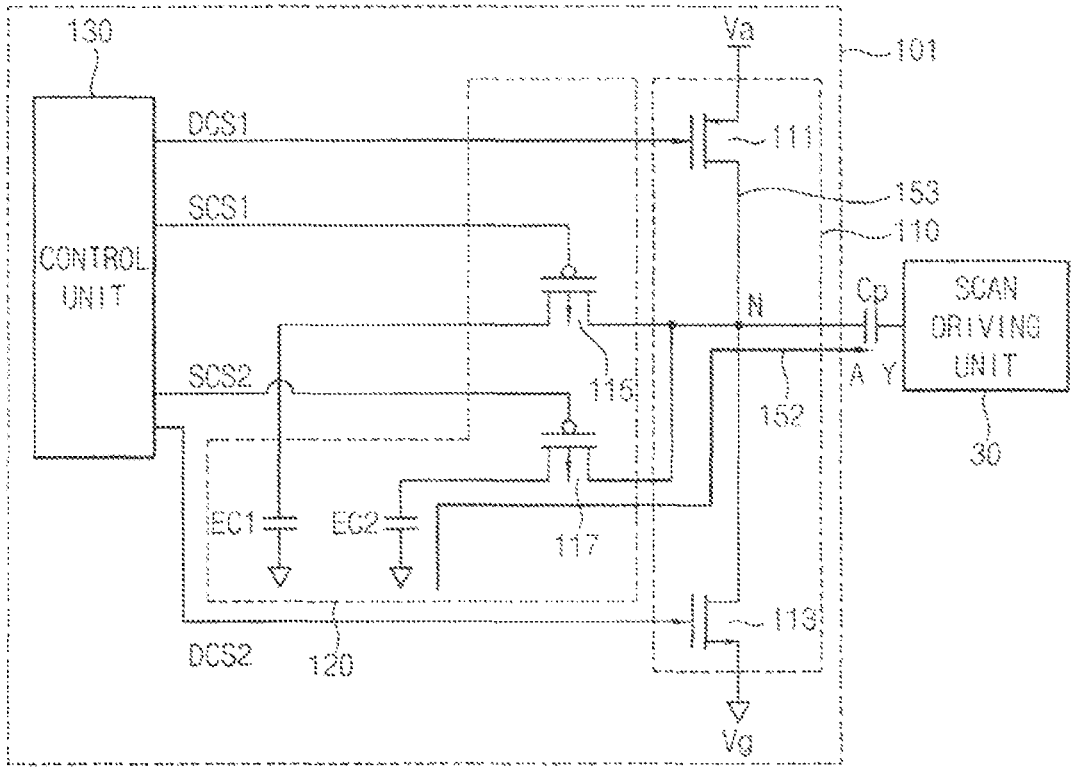

Referring to FIG. 5B, as is described with reference to FIG. 4, during the P2 time period, the second switching element 117 is turned on, and a current path 152 is formed from the second energy recovery capacitor EC2 through the second switching element 117 and the node N to the panel capacitor Cp, and thus, the voltage of the address electrode A rises from the first intermediate voltage V1 to the second intermediate voltage V2.

Figure 5C:
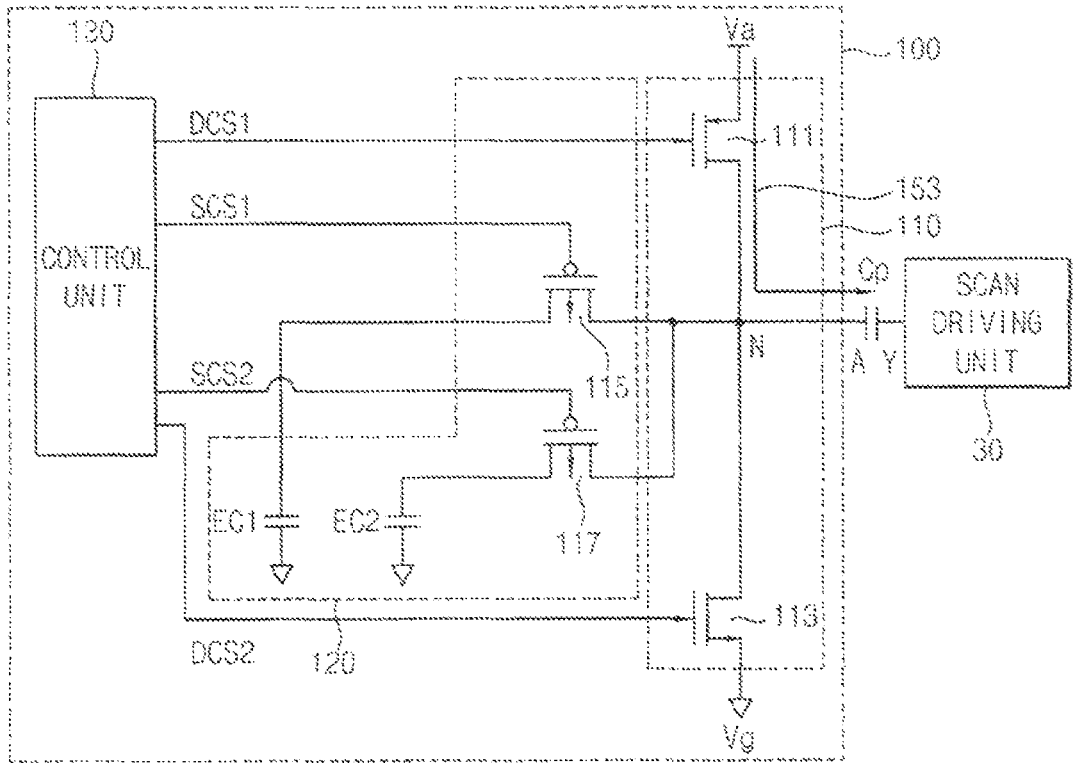

Referring to FIG. 5C, as is described with reference to FIG. 4, during the P3 time period, the first driving device 111 is turned on, and a current path 153 is formed from the address voltage Va through the node N to the panel capacitor Cp, and thus, the voltage of the address electrode A rises from the second intermediate voltage V2 to the address voltage Va and is maintained at the address voltage Va.

Figure 5D:
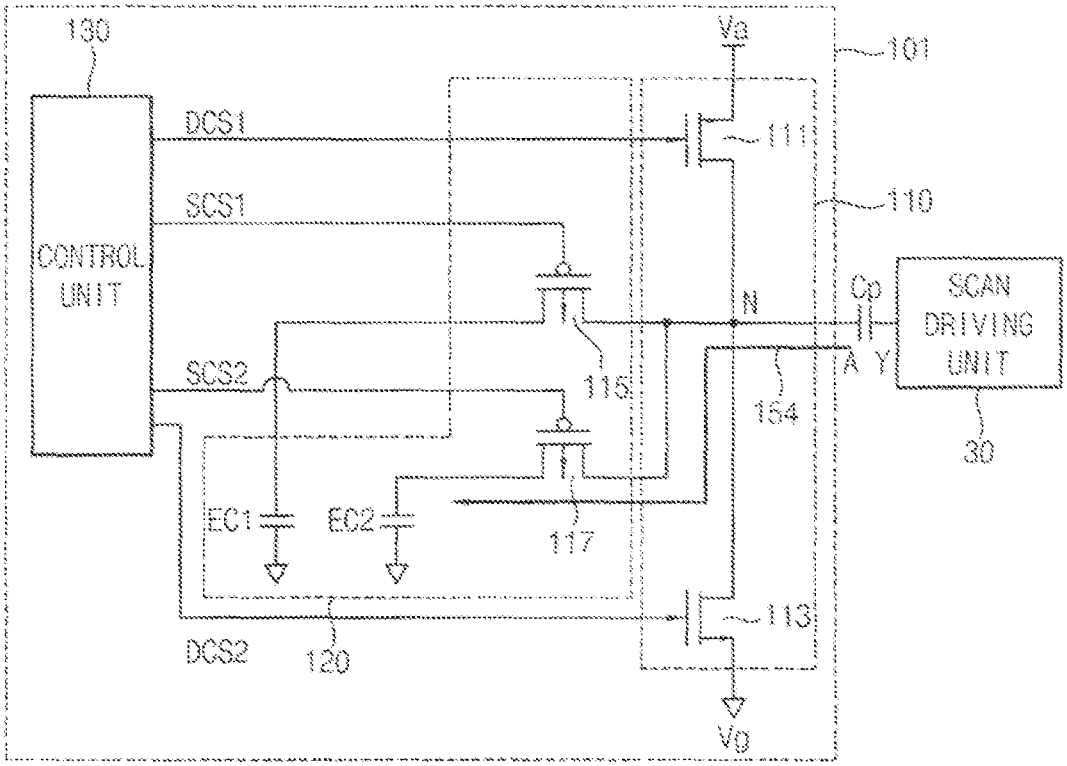

Referring to FIG. 5D, as is described with reference to FIG. 4, during the P4 time period, the second switching element 117 is turned on, and a current path 154 is formed from the panel capacitor Cp through the node N and the second switching element 117 to the second energy recovery capacitor EC2, and thus, a portion of the voltage charged to the panel capacitor Cp is recovered to the second energy recovery capacitor EC2. Therefore, the voltage of the address electrode A falls from the address voltage Va to the second intermediate voltage V2.

Figure 5E:
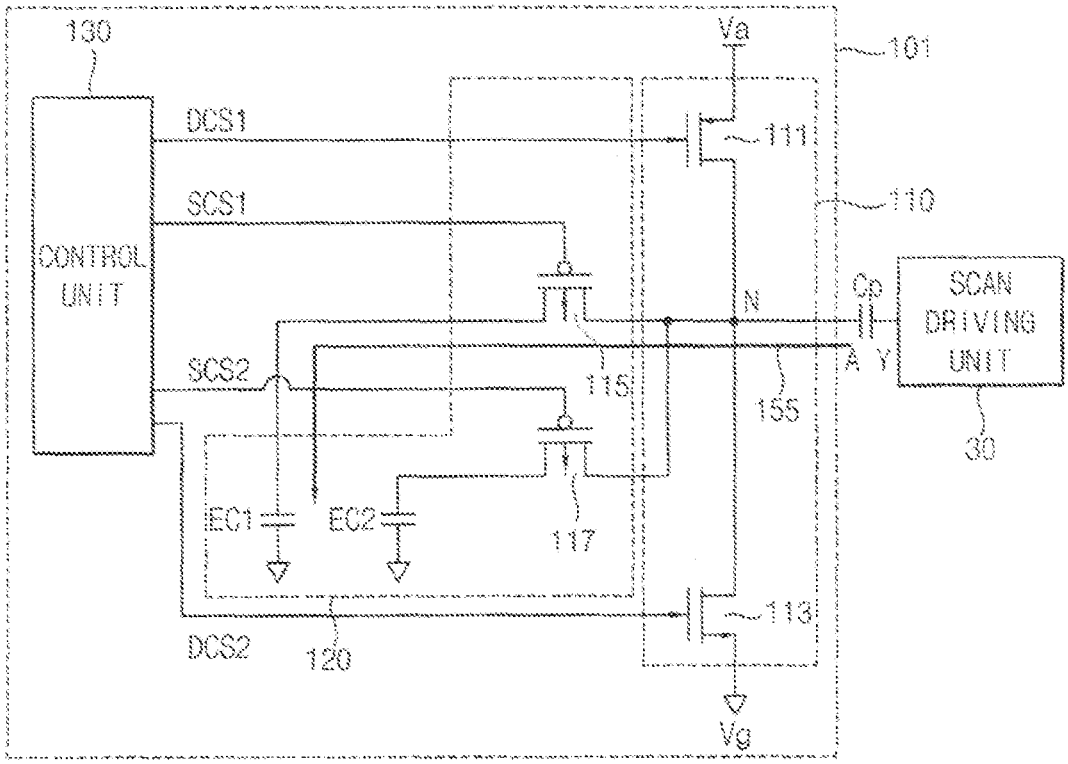

Referring to FIG. 5E, as is described with reference to FIG. 4, during the P5 time period, the first switching element 115 is turned on, and a current path 155 is formed from the panel capacitor Cp through the node N and the first switching element 115 to the first energy recovery capacitor EC1, and thus, a portion of the voltage charged to the panel capacitor Cp is recovered to the first energy recovery capacitor EC1. Therefore, the voltage of the address electrode A falls from the second intermediate voltage V2 to the first intermediate voltage V1.

Figure 5F:
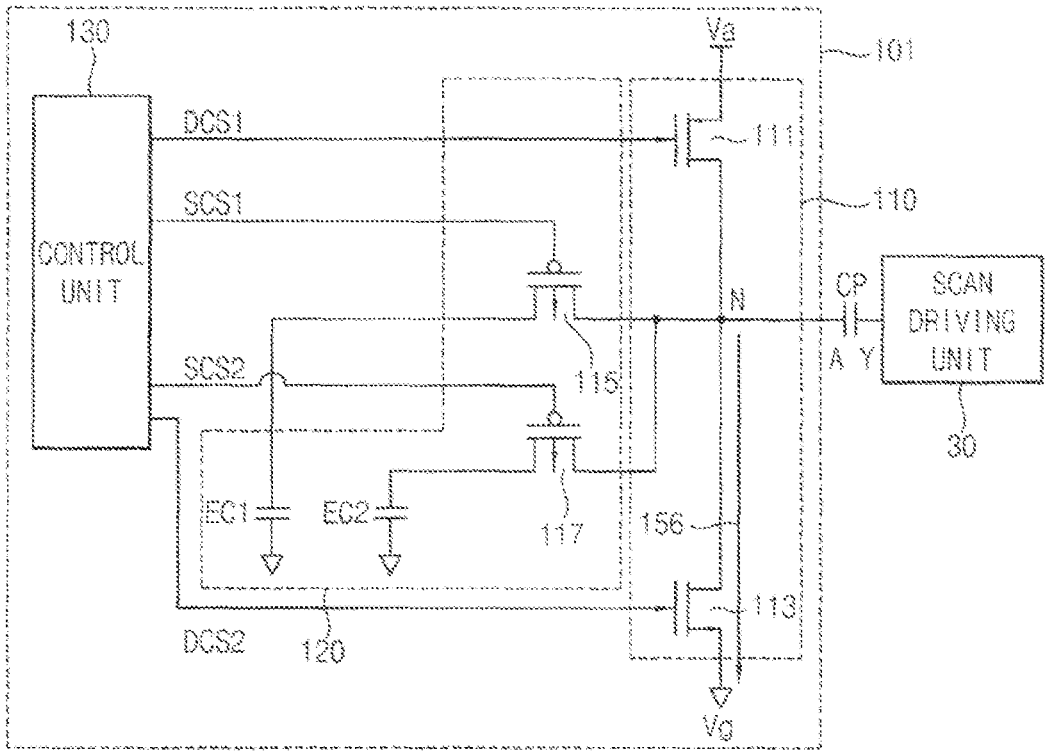

Referring to FIG. 5F, as is described with reference to FIG. 4, during the P6 time period, the second driving device 113 is turned on, and a current path 156 is formed from the panel capacitor Cp through the node N and the second driving device 113 to the reference voltage Vg, and thus, the voltage of the address electrode A falls from the first intermediate voltage V1 to the reference voltage Vg and is maintained at the voltage Vg.

The address driving circuit 101 according to an exemplary embodiment raises or lowers the voltage of the address electrode A via at least two intermediate voltages V1, V2 by using the energy recovery circuit 120 when driving the address electrode A to the address voltage Va or the reference voltage Vg. Therefore, EMI can be reduced when compared with a case that the voltage of the address electrode A is directly raised from the reference voltage Vg to the address voltage Va or the voltage of the address electrode A is directly lowered from the address voltage Va to the reference voltage Vg.

Figure 6:
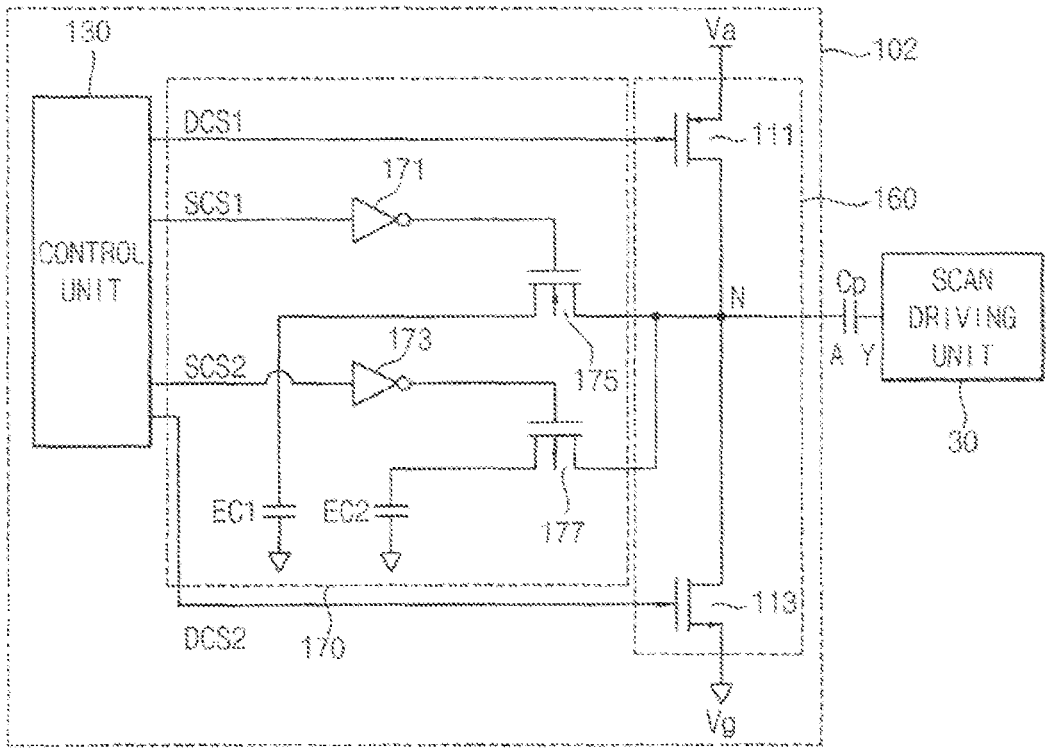
FIG. 6 is a circuit diagram illustrating an address driving circuit according to an exemplary embodiment.

FIG. 6 is a circuit diagram illustrating an address driving circuit according to another exemplary embodiment.

Referring to FIG. 6, an address driving circuit 102 includes a driving device unit 160 and an energy recovery circuit 170. The address driving circuit 102 may further include a control unit 130.

The driving device unit 160 includes a first driving device 111 and a second driving device 113, which is similar to the driving device unit 130 in FIG. 3. Therefore, a further detailed description of the driving device unit 160 is not needed.

The energy recovery circuit 170 includes a first inverter 171, a second inverter 173, a first energy recovery capacitor EC1, a second energy recovery capacitor EC2, a first switching element 175, and a second switching element 177. The first switching element 175 and the second switching element 177 may be implemented with a symmetric p-channel double diffusion MOS transistor. When the first switching element 175 and the second switching element 177 are implemented by a symmetric n-channel double diffusion MOS transistor and the first and the second switching control signals SCS1, SCS2 are as illustrated in FIG. 4, signals having waveforms as illustrated in FIG. 4 may be applied to the address driving circuit 102 because the address driving circuit 102 includes the first and second inverters 171, 173. When the first and the second switching control signals SCS1, SCS2 have waveforms opposite to the waveforms of FIG. 4, the driving circuit 102 need not include the first and second inverters 171, 173. The operation of the address driving circuit 102 is similar to the operation of the address driving circuit 101, and, as such, a further detailed description of the address driving circuit 102 is not needed.

Figure 7A:
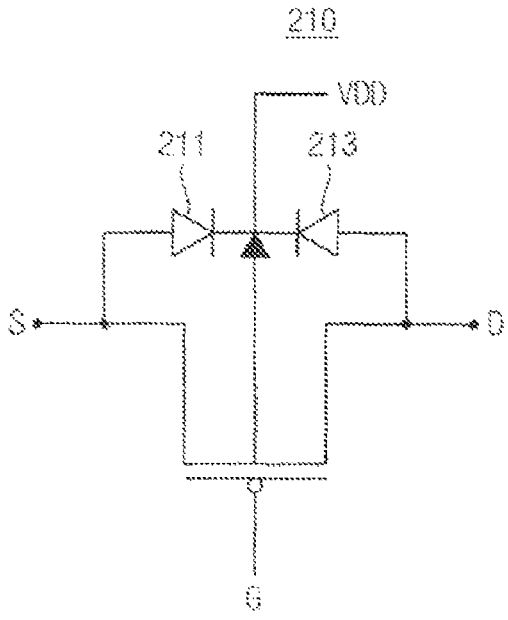
FIGS. 7A and 7B illustrate a symmetric double diffusion MOS transistor that is capable of being employed as the switching element of FIGS. 3 and 6.
Figure 7B:
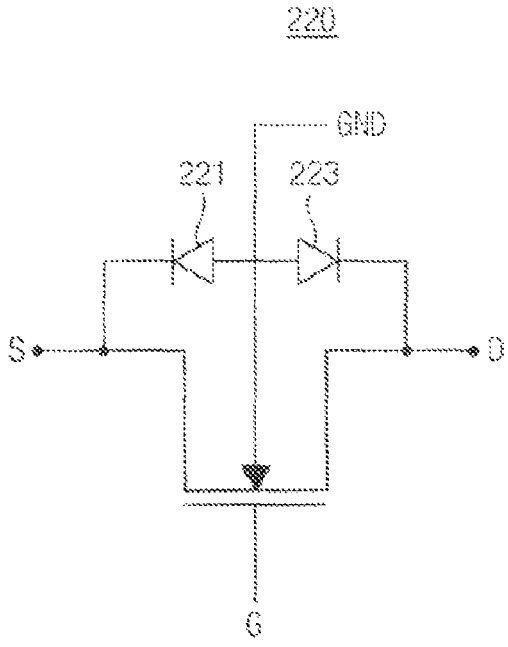

FIGS. 7A and 7B illustrate a symmetric double diffusion MOS transistor that is capable of being employed as the switching element of FIGS. 3 and 6.

FIG. 7A is a equivalent circuit diagram illustrating a p-channel symmetric double diffusion MOS transistor that is capable of being employed as the switching elements 115, 117 of FIG. 3.

Referring to FIG. 7A, when a power supply voltage VDD is applied to a semiconductor substrate of the p-channel symmetric double diffusion MOS transistor 210, the p-channel symmetric double diffusion MOS transistor 210 has two parasitic body diodes 211, 213 in its equivalent circuit. Accordingly, when a current flows from a drain electrode D to a source electrode S or vice versa, the two parasitic body diodes 211, 213 are not turned on, and thus, it is possible to conduct current bi-directionally between the source electrode S and the drain electrode D.

FIG. 7B is an equivalent circuit diagram illustrating a n-channel symmetric double diffusion MOS transistor that is capable of being employed as the switching elements 175, 177 of FIG. 6.

Referring to FIG. 7B, when a ground voltage GND is applied to a semiconductor substrate of the n-channel symmetric double diffusion MOS transistor 220, the n-channel symmetric double diffusion MOS transistor 220 has two parasitic body diodes 221, 223 in its equivalent circuit. Accordingly, when a current flows from a drain electrode D to a source electrode S or vice versa, the two parasitic body diodes 221, 223 are not turned on, and thus, it is possible to conduct current bi-directionally between the drain electrode D and the source electrode S.

The switching elements of FIGS. 3 and 6 are capable of conducting current bi-directionally by employing the symmetric double diffusion MOS transistors of FIGS. 7A and 7B. Accordingly, the panel capacitor Cp may be charged by conducting current from each of the energy recovery circuits 120, 170 to the panel capacitor Cp, and the voltage charged to the panel capacitor Cp may be recovered by conducting current from the panel capacitor Cp to the each of the energy recovery circuits 120, 170. The switching elements of FIGS. 3 and 6 are also referred to as a bi-directional switch because the switching elements of FIGS. 3 and 6 employ the symmetric double diffusion MOS transistors of FIGS. 7A and 7B.

Figure 8:
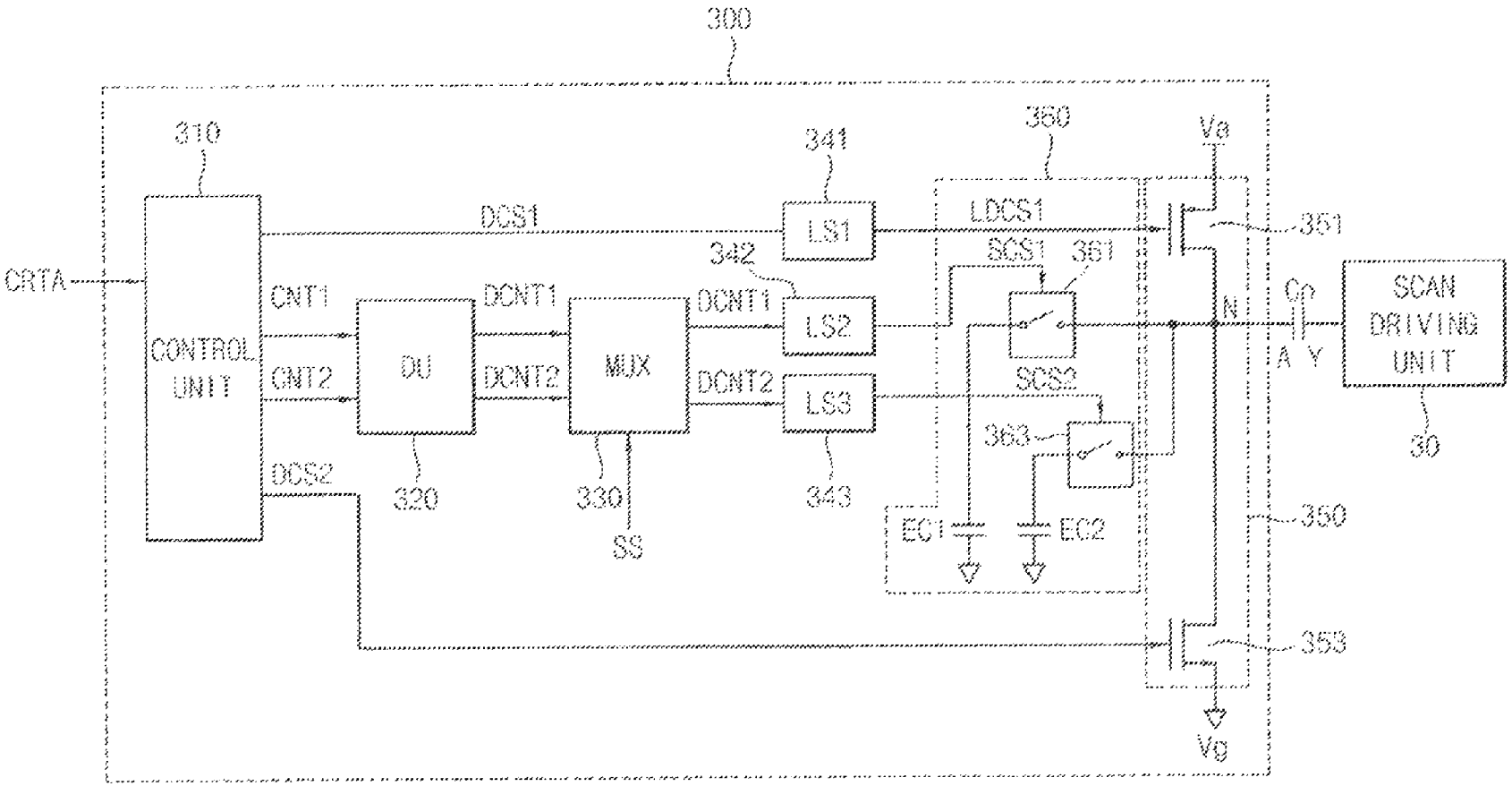
FIG. 8 is a circuit diagram illustrating an address driving circuit according to an exemplary embodiment.

FIG. 8 is a circuit diagram illustrating an address driving circuit according to still another exemplary embodiment.

Referring to FIG. 8, an address driving circuit 300 includes a control unit 310, a delay unit 320, a multiplexer 330, first through third level shifters 341, 342, 343, a driving device unit 350 and an energy recovery circuit 360.

The control unit 310 generates first and second driving control signals DCS1, DCS2 and first and second control signals CNT1, CNT2 in response to a timing control signal CRTA from the timing controller 20 of FIG. 1. The first and second control signals CNT1, CNT2 are for controlling switching elements 361, 363 of the energy recovery circuit 360. The control unit 310 may be outside of the address driving circuit 300.

The delay unit 320 selectively delays the first and second control signals CNT1, CNT2 to provide delayed control signals DCNT1, DCNT2. The delay unit 320 may control enabling periods of the first and second control signals CNT1, CNT2. The multiplexer 330 selects the first and second delayed control signals DCNT1, DCNT2 in response to a selection signal SS. The multiplexer 330 may select an output timing of the delayed control signals DCNT1, DCNT2.

The first level shifter 341 shifts the voltage level of the first driving control signal DCS1 to provide a high-voltage driving control signal LDCS1. The second level shifter 342 shifts the voltage level of the first delayed control signal DCNT1 to provide a first switching control signal SCS1 having a high voltage level. The third level shifter 343 shifts the voltage level of the second delayed control signal DCNT2 to provide a second switching control signal SCS2 having a high voltage level.

The driving device unit 350 includes a first driving device 351 connected to the address voltage Va and a second driving device 353 connected to the reference voltage Vg. The first driving device 351 and the second driving device 353 are connected to each other at a node N which is connected to the panel capacitor Cp. The first driving device 351 may be implemented with a p-type MOS transistor, and the second driving device 353 with a n-type MOS transistor.

The energy recovery circuit 360 includes a first energy recovery capacitor EC1, a second energy recovery capacitor EC2, a first switching element 361, and a second switching element 363. The first switching element 361 is connected between the first energy recovery capacitor EC1 and the node N. The second switching element 363 is connected between the second energy recovery capacitor EC2 and the node N. The first and second switching elements 361, 363 may be implemented with a high-voltage bi-directional switch. That is, The first and second switching elements 361, 363 may employ the symmetric double diffusion MOS transistors of FIGS. 7A and 7B.

The first driving device 351 pulls-up the node N in response to the high-voltage driving control signal LDCS1. The second driving device 353 pulls-down the node N in response to the second driving control signal DCS2.

Each of the switching elements 361, 363 are turned on/off in response to each of the first and second switching control signals SCS1, SCS2 having high voltage level, thereby raising or lowering the address electrode A via the first and second intermediate voltages V1, V2 as illustrated in FIG. 4.

The first through third level shifters 341, 342, 343 of FIG. 8 respectively shift each voltage level of the first driving control signal DCS1, the first delayed control signal DCNT1 and the second delayed control signal DCNT2, thereby ensuring that the first driving device 361, the first switching element 361 and the second switching element 363 operate stably.

The operation of the address driving circuit 300 of FIG. 8 is similar to the operation of the address driving circuit 101 of FIG. 3, and, as such, a detailed description of the address driving circuit 300 is not needed.

As mentioned above, the plasma device according to exemplary embodiments of the inventive concept is capable of increasing energy efficiency due to reducing heat radiation and reducing EMI by driving the address electrodes to a high voltage or a lower voltage via at least two intermediate voltages. Therefore, the plasma device according to exemplary embodiments may be employed in a plasma display device including a large-sized plasma display.

The foregoing is illustrative of exemplary embodiments and is not to be construed as limiting thereof. Although representative practical exemplary embodiments have been described, those skilled in the art will readily appreciate that many modifications are possible in the exemplary embodiments without materially departing from the present application's inventive concepts. Accordingly, all such modifications, as well as other exemplary embodiments of the inventive concept, are intended to be included within the scope of the appended claims.

What is claimed is:

1. An address driving circuit comprising:

a driving device unit configured to drive an address electrode to an address voltage or a reference voltage in response to driving control signals during an address period; and an energy recovery circuit configured to recover a voltage charged to the address electrode in response to switching control signals such that a voltage of the address electrode transitions to the address voltage or the reference voltage through at least two intermediate voltages including a first intermediate voltage and a second intermediate voltage during the address period, wherein the energy recovery circuit comprises:

a first switching element, connected to the address electrode, which receives a first switching control signal;

a second switching element, connected to the address electrode and to the first switching element in parallel, which receives a second switching control signal;

a first energy recovery capacitor, connected to the first switching element, which recovers the voltage charged to the address electrode; and a second energy recovery capacitor, connected to the second switching element, which recovers the voltage charged to the address electrode.

2. The address driving circuit of claim 1, wherein the energy recovery circuit raises the voltage of the address electrode from the reference voltage to the first intermediate voltage in response to a first switching control signal, and raises the voltage of the address electrode from the first intermediate voltage to the second intermediate voltage in response to a second switching control signal when the voltage of the address electrode rises from the reference voltage to the address voltage.

3. The address driving circuit of claim 1, wherein the energy recovery circuit lowers the voltage of the address electrode from the address voltage to the second intermediate voltage in response to a second switching control signal, and lowers the voltage of the address electrode from the second intermediate voltage to the first intermediate voltage in response to a first switching control signal when the voltage of the address electrode falls from the address voltage to the reference voltage.

4. The address driving circuit of claim 1, wherein a first rising transition time period is determined based upon a first turn-on time period of the first switching element in response to the first switching control signal and a second rising transition time period is determined based upon a second turn-on time period of the second switching element in response to the second switching control signal, and wherein the first rising transition is a time period for the voltage of the address electrode to rise from the reference voltage to the first intermediate voltage, and the second rising transition time period is a time period for the voltage of the address electrode rising from the first intermediate voltage to the second intermediate voltage.

5. The address driving circuit of claim 1, wherein the first switching element and the second switching element comprise symmetric double diffusion MOS transistors.

6. The address driving circuit of claim 1, wherein the first switching element and second switching element comprise n-type symmetric double diffusion MOS transistors.

7. The address driving circuit of claim 1, wherein the first switching element and the second switching element comprise p-type symmetric double diffusion MOS transistors.

8. The address driving circuit of claim 1, wherein the driving device unit comprises:

a first driving device, connected to a first power supply voltage having a level of the address voltage, which pulls-up the voltage of the address electrode to the address voltage in response to a first driving control signal; and a second driving device, connected to a second power supply voltage having a level of the reference voltage, which pulls-down the voltage of the address electrode to the reference voltage in response to a second driving control signal.

9. The address driving circuit of claim 8 wherein the first driving device comprises an NMOS transistor, and the second driving device comprises a PMOS transistor.

10. The address driving circuit of claim 1, further comprising a control unit configured to generate the driving control signals and the switching control signals.

11. The address driving circuit of claim 10, further comprising a delay unit that controls delay time periods of the switching control signals to provide delayed control signals.

12. The address driving circuit of claim 11, wherein a first falling transition time period and a second falling transition time period are determined based upon the delay time periods of the switching control signals, and wherein the first falling transition time period is a time period for the voltage of the address electrode to fall from the address voltage to the second intermediate voltage and the second falling transition time period is a time period for the voltage of the address electrode to fall from the second intermediate voltage to the first intermediate voltage.

13. A plasma display device comprising:

a plasma display panel comprising a plurality of address electrodes; and an address driving unit comprising an energy recovery circuit, the address driving unit configured to drive a voltage of each address electrode from a reference voltage to an address voltage through a first intermediate voltage and a second intermediate voltage by using a voltage stored in the energy recovery circuit or configured to drive the voltage of the address electrode from the address voltage to the reference voltage through the second intermediate voltage and the first intermediate voltage by recovering the voltage of the address electrode to the energy recovery circuit, in response to control signals, wherein the energy recovery circuit comprises:

a first switching element, connected to the address electrode, which receives a first switching control signal;

a second switching element, connected to the address electrode and to the first switching element in parallel, which receives a second switching control signal;

a first energy recovery capacitor, connected to the first switching element, which recovers the voltage charged to the address electrode; and a second energy recovery capacitor, connected to the second switching element, which recovers the voltage charged to the address electrode.

14. A plasma display device comprising:

a plasma display panel having a discharge space;

a scan driving unit having scan electrodes that cross the plasma display panel;

a sustain driving unit having sustain electrodes that cross the plasma display panel, each sustain electrode being paired with a scan electrode; and an address driving unit having address electrodes that cross the scan electrodes and the sustain electrodes;

wherein discharges occur in the discharge space and images are displayed on the plasma display panel in response to respective driving voltages applied to the address electrodes, to the scan electrodes and to the sustain electrodes during subfields of a frame, the subfields each having at least a reset period and an address period, wherein, during the address period an address discharge for selecting a discharge cell to be discharged is generated by a voltage difference between an address voltage of the address electrodes and a scan voltage of the scan electrodes, wherein during the address period, a scan pulse is applied to the scan electrodes while an address signal is applied to the address electrode, the address signal going through at least two intermediate voltages during a transition time period to reach the address voltage such that when a voltage difference between the scan pulse and the address signal is added to a wall voltage generated during the reset period preceding the address period, the address discharge is generated within the discharge space to which the address signal is applied.

15. The plasma display device of claim 14, wherein the at least two intermediate voltages are provided as:

a first stage transitioning voltage that transitions from a first voltage to a second voltage that is greater than the first voltage, and a second stage transitioning voltage that follows the first stage transitioning voltage and that transitions from the second voltage to the address voltage that is greater than the second voltage.

16. The plasma display device of claim 15, wherein the at least two intermediate voltages are provided from respective capacitors of an energy recovery circuit coupled to the address electrodes.

17. The plasma display device of claim 16, wherein during a time period after the address voltage is applied voltages are recovered from a panel capacitance between the address electrode and the scan electrode to the capacitors of the energy recovery circuit.

* * * * *